United States Patent [19]

Emmerich et al.

[11] 4,255,109

[45] Mar. 10, 1981

[54] SPINNERET CLEANING DEVICE

[75] Inventors: Hermann Emmerich, Klingenberg; Rudolf Ottmann, Aschaffenburg, both of Fed. Rep. of Germany

[73] Assignee: Akzona Incorporated, Asheville, N.C.

[21] Appl. No.: 41,962

[22] Filed: May 23, 1979

[30] Foreign Application Priority Data

Jun. 9, 1978 [DE] Fed. Rep. of Germany ..... 2825356

[51] Int. Cl.[3] ..... D01D 3/00

[52] U.S. Cl. ..... 425/227; 264/39; 264/169; 425/464

[58] Field of Search ..... 425/464, 311, 225, 227; 264/169, 39

[56] References Cited

U.S. PATENT DOCUMENTS

| | | | |
|---|---|---|---|
| 1,279,678 | 9/1918 | English et al. | 425/314 |
| 1,752,689 | 4/1930 | Ohlson | 264/169 |
| 2,614,290 | 10/1952 | Street | 425/311 |
| 3,196,487 | 7/1965 | Shelling | 425/311 |
| 3,341,945 | 9/1967 | Chase | 30/169 |
| 3,804,569 | 4/1974 | Walker | 425/225 |

*Primary Examiner*—Jay H. Woo

*Attorney, Agent, or Firm*—Francis W. Young; Tom R. Vestal

[57] ABSTRACT

A spinneret cleaning device for removing deposits quickly, reliably and uniformly has an adjustable force flat plane cleaning blade.

6 Claims, 11 Drawing Figures

SPINNERET CLEANING DEVICE

DESCRIPTION OF THE PRIOR ART

Spinnerets, especially those used for melt spinning, must generally be cleaned during spinning-in and subsequently in cycles—as well as in the case of unexpected spinning malfunctions—to remove oligomers, thermally degraded melt, etc. deposited on the spinneret orifices. In most cases, said cleaning must be performed without interrupting the melt stream through the spinneret and without removing the spinnerets from the spinning machine for this purpose.

Very useful and widely used devices for this purpose are hand spatulas, as described in e.g. U.S. Pat. No. 3,341,945. The force at which such spatula is applied during cleaning on the spinneret face, as well as the guiding of the spatula on the spinneret face depend upon the handling of the operators and the spinneret may easily be damaged. Moreover, duration and success of the cleaning procedure depend on the dexterity and know-how of the operators.

U.S. Pat. No. 3,804,569 describes a spatula mounted on a bracket rotatable on a shaft. With this device, however, the spatula can only be operated when the shaft of the device is first screwed into a tap hole provided for this purpose in the spinneret. Moreover, precise adjustment of the pressure force between spatula and spinneret is quite difficult.

THE PRESENT INVENTION

These drawbacks had to be eliminated. Therefore, the subject matter of the present invention is to provide a device which would more quickly and more readily than heretofore cleans spinnerets—especially those used for melt spinning—while insuring gentlest treatment of the spinneret face and spinneret orifices. Furthermore, the present device will make it possible even for unskilled personnel to clean a number of spinnerets quickly, reliably and uniformly.

This objective is met by a device to clean operational spinnerets installed in a spinning machine whereby the device has at least one cleaning blade movable in a plane parallel to and in contact with said face, whereby the side of the cleaning blade of the invention facing the spinneret surface assumes the shape of a flat plane, whereby the cleaning blades can be pressed on the spinneret face at an adjustable force, whereby the device is provided with form-fitting guiding means, and whereby the cleaning blades are movably aligned in all points on planes of identical shape and path length.

In contrast to known similar devices, the cleaning blades of the device of the invention do not revolve around a common axis inside or outside of the blades, but rather perform a circular motion whereby each point of the blade rotates around its own axis, or performs a reciprocating movement over a specific zone of identical length.

To clean spinnerets having orifices arranged e.g. in one or more orifice rings, devices with a corresponding number of properly dimensioned round cleaning blades were found useful, whereas, for spinnerets with orifices aligned e.g. in rows, devices with a suitable number of properly dimensioned and aligned straight cleaning blades were found useful.

The device of the invention is suitable not only for spinnerets with round orifices of specific size, but also for spinnerets with orifices of optional shape and/or dimension.

To insure the contact of the cleaning blades with the spinneret face at all times, it is expedient to connect the blades e.g. by means of a ball or universal joint to the drive shaft. The adjustable pressure force of the cleaning blades can be easily obtained by elastic elements such as compression or coil springs.

The design of the side of the cleaning blade in contact with the spinneret face in the form of a flat plane has the advantage that if the proper blade material is selected, the blades need not be sharpened even after prolonged use since they sharpen automatically during spinneret cleaning.

A most expedient version of the device of the invention has proved to be one which is light in weight and handy and can be conveniently and readily carried by an operator from spinneret to spinneret and there be rapidly and simply put in operating position. Since for unobjectionable cleaning of spinnerets it is advantageous to have the device of the invention as much as possible always in the same position on each spinneret to be cleaned, the device is expediently provided with e.g. two protruding bolts or pins, which can be inserted in a form-fitting manner in suitably aligned and dimensioned bores provided on the spinning machine in each spinneret zone. However, the surface of the spinneret to be cleaned lies frequently in a different plane than e.g. the housing or insulation of the spinning machine. The resulting projections and recesses in the spinneret zones can, when the device of the invention is properly designed, be used as guidance to bring the device of the invention accurately in position. With a functional design of such guidance, it is no longer necessary to fasten the device of the invention additionally in another manner, but all that is needed is for the operator to hold the device during cleaning of the spinnerets merely by hand in the operating position.

A version whereby the electrical drive motor for the cleaning blades is connected with said blades by means of a rigid drive shaft offers the advantage of being compact and easily handled. However, depending on the weight of the motor, this version, when used frequently or constantly, may under certain conditions result in rapid tiring of the operator. To eliminate this possibility, it is e.g. possible to have this version mounted on a displaceable stand or suspended movably and displaceably from an overhead trolley rail and furthermore to compensate partly or totally for the weight of the device by proper counterweights.

A very handy and readily operated version has proved to be one whereby the drive motor for the cleaning blades is mounted on a displaceable stand and whereby the cleaning blades of the device of the invention are put in motion merely by means of a flexible shaft. This version is especially characterized by a very low weight.

Depending on the spinning orifice pattern in the spinnerets, the cleaning blades may assume a straight or circular shape or any other suitable shape, whereby each cleaning blade is assigned to one, two or even several rows of spinning orifices.

The quickest cleaning is, of course, obtained when each row of orifices has only one cleaning blade assigned to it. However, when the rows of spinning orifices are very close together, said assignment of the cleaning blades may, under certain conditions, result in too narrow an alignment for unobjectionable and troublefree cleaning of the spinnerets. The most efficient assignment of the cleaning blades, therefore, is best determined by simple trials.

When several cleaning blades are used, it is expedient to align these on a common base plate, which should expediently be secure against torque/rotation around its center. This eliminates the possibility that during cleaning of the spinnerets coated with melt, any spun or undrawn material be taken up by the cleaning head from which it can subsequently be removed only with considerable effort. If said common base plate for the cleaning blades is driven by a crank or eccentric pin of a rotating shaft, the base plate and with it the cleaning blades—depending on the meshing and the guideway of the pin in the base plate—will perform a purely reciprocating motion or a circling motion determined by the eccentricity of the pin. With both types of motions, all points of the base plate and of the cleaning blades describe paths of the same shape and dimension.

During uninterrupted or briefly interrupted use of the device of the invention, there is substantial heating of the cleaning blades which frequently interferes with impeccable cleaning of the spinnerets and under certain conditions makes it even impossible. In these cases, it is advantageous and normally sufficient to have a cooling unit for the cleaning blades, e.g. a blowing system, with which the cleaning blades are expediently cooled prior to cleaning the next spinneret.

These spaces between the cleaning blades should be large enough so that during the cleaning process with operational spinneret, any spun material can be accommodated therein. The necessary adjustment of the volume of these spaces to the operational situation and requirements is most expediently achieved by suitable dimensioning of the height of the cleaning blades, since, as described earlier, the number, shape and arrangement of the cleaning blades is determined by the number and arrangement of the spinneret orifices.

To clean the knives and the spaces between them of spun material and adhering solidified melt, it has been found expedient to use a cage-like housing or a grid-like plate provided with slots permitting passage of the cleaning blades, the shape and size of said slots being precisely adjusted to the shape and dimension of the cleaning blades. At rest, in this version of the device of the invention, the blades are located within the housing or under the grid-like plate, as a result of which they offer some protection to the cleaning blades against damage. Before starting to clean a spinneret, the cleaning blades in this version are brought into operating position through the slots of the housing or plate. After completing the cleaning, they are retracted whereby melt adhering to the cleaning blades and spun material between the spaces is stripped away and discarded into a waste container.

Within the framework of conventional technological dimensions, there are no limits set to the size of the device of the invention. It is, however, expedient to adjust it to the dimensions of the spinnerets or spinning machines used. The thickness of the side of the cleaning blade in contact with the spinneret face to be cleaned should, however, be as small as possible. Conventional blade thicknesses are in the range of 1 mm.

In selecting a suitable material for the cleaning blades, care should be taken that compared with the material of the spinneret, the former not be too hard in order to avoid damage by the cleaning blades to the spinnerets. Consequently, good results are achieved with e.g. cleaning blades of brass, bronze, cast iron or aluminum. Very good results are always obtained when the cleaning blades—prior to use—are treated with an agent reducing the surface adhesion and are to this end coated with Teflon or silicone. In many cases, especially with polyamide 6, the grid-shaped cleaning plate can, as a result, be eliminated.

BRIEF DESCRIPTION OF THE DRAWINGS

The invention and its operational method are explained in detail by means of the figures representing potential versions of the device of the invention.

DETAILED DESCRIPTION OF THE DRAWINGS

Figure 1:
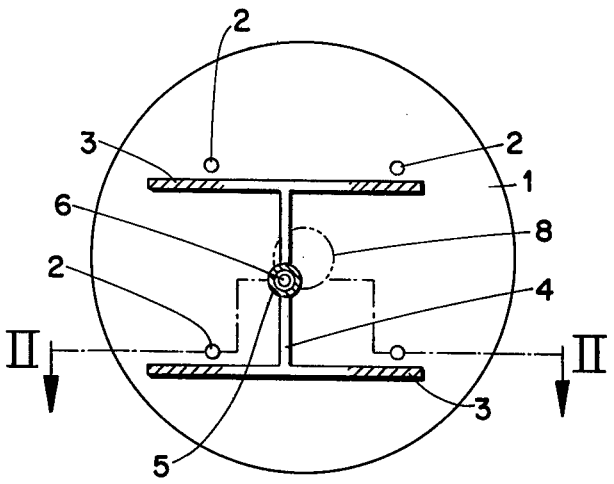
FIG. 1 is a section along line I—I through the version of the invention (shown in simplified form in FIG. 2) with two cleaning blades and a four hole spinneret.
Figure 2:
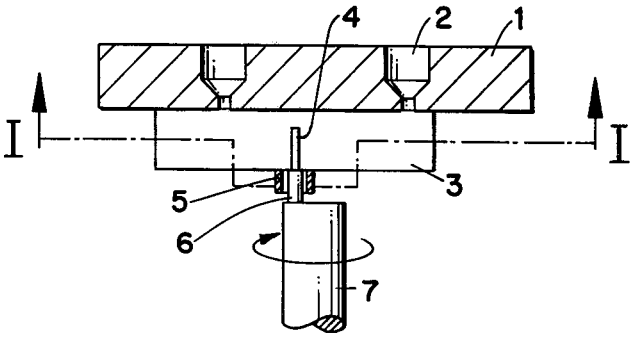
FIG. 2 is a section through FIG. 1 along line II—II.

The spinneret in FIG. 1 has four spinneret holes 2, through which the spinning mass is extruded and molded into filaments. The four spinning holes 2 are arranged in two rows of two spinning holes 2, each. Two straight cleaning blades 3, connected by a bridge 4 serve to clean the four spinning holes 2. A guideway 5 is located on said bridge 4 in which the eccentric pin 6 of the rotatably mounted drive shaft 7 engages, whereby eccentric pin 6 is designed to rotate freely in guideway 5. As the shaft 7 rotates, eccentric pin 6 moves over a circular path 8. The non-friction contact connection between eccentric pin 6 and guideway 5 causes the cleaning blades 3 and the connecting bridge 4 to move likewise on a circular path in such a manner that each point of cleaning blades 3 and bridge 4 describe a circular path of the same size as that described by eccentric pin 6. During one revolution of shaft 7, cleaning blades 3 pass twice over the two spinning holes 2 assigned to them. To prevent rotation of bridge 4 with cleaning blades 3 connected thereto around the axial center of guideway 5, it may be advantageous to provide known means inhibiting such rotation, which means are not shown in FIGS. 1 and 2.

Figure 3:
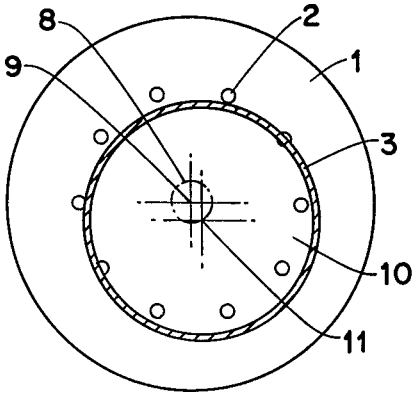
FIG. 3 is a section of a circular cleaning blade of the device of the invention and a spinneret with circular disposition of the spinning holes.

In FIG. 3, the spinning holes 2 of spinneret 1 are aligned on a common orifice circle. Hence, spinning holes 2 are at the same distance from the center point 9 of the orifice circle. The spinning holes 2 of this spinneret 1 are cleaned by means of a circular cleaning blade 3 mounted on a base plate 10. Here, cleaning blade 3 has the same OD as base plate 10. Base plate 10 with cleaning blade 3 mounted thereon is driven in the same manner as in the version described in FIGS. 1 and 2, whereby here the eccentric pin of the drive shaft engages the center 11 of base plate 10. As the drive shaft rotates, center point 11 of base plate 10 moves over circular path 8 around center point 9 of the orifice circle of spinneret 1. All points of base plate 10, expediently secured against rotation around its center point 11, and of cleaning blade 3 describe also a circular path of the same dimension as that of center point 11 of base plate 10. During one revolution of the shaft, circular cleaning blade 3 thus passes twice over each spinning hole 2, namely once each from essentially opposite directions.

Figure 4:
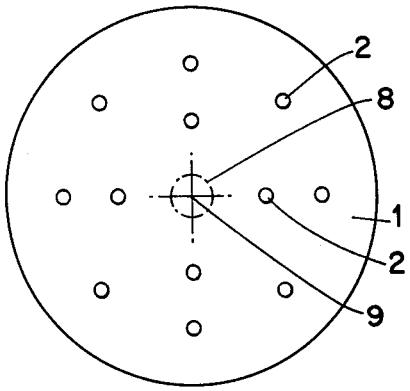
FIG. 4 is a spinneret with spinning orifices arranged over two circles of orifices of differing diameter.
Figure 5:
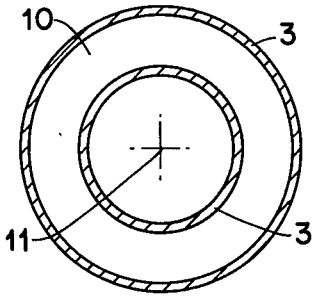
FIG. 5 is a section through two circular cleaning blades of the invention arranged on a common base plate and suitable to clean spinnerets according to FIG. 4.

FIG. 4 shows a spinning plate 1 with spinning holes 2 arranged in two concentric orifice circles of different diameter. This spinneret can be cleaned e.g. with cleaning blades 3 (shown in FIG. 5) mounted on a common base plate 10. In this version, base plate 10 has the same diameter as the outermost of the two cleaning blades 3. In keeping with the alignment of spinning holes 2 of spinneret 1 in FIG. 4, the two cleaning blades 3 are also aligned in concentric arrangement on base plate 10 and have an average diameter identical to the orifice circle diameter of the spinning holes 2 assigned to them. In cleaning spinneret 1, base plate 10 and along with it the two cleaning blades 3 perform a circular motion, whereby center 11 of base plate 10 moves on a circular path 8 shown in FIG. 4. Base plate 10 does not thereby revolve around its center point 11.

Figure 6:
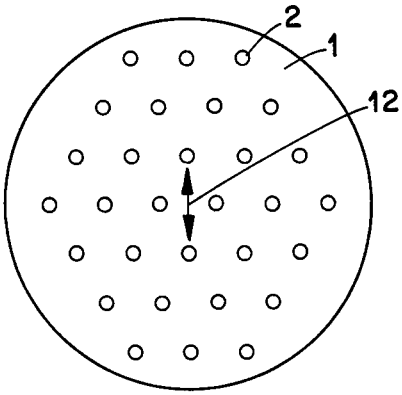
FIG. 6 is a spinneret with seven rows of spinning holes.
Figure 7:
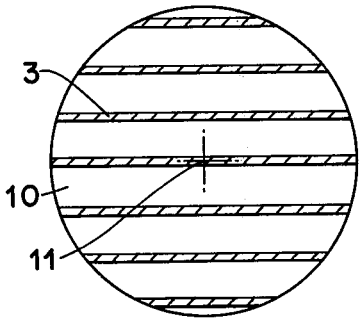
FIG. 7 is a section through seven straight cleaning blades arranged on a common base plate and suitable for the cleaning of spinnerets according to FIG. 6.

In FIG. 6, spinneret 1 has spinning holes 2 aligned in seven mutually parallel orifice rows. To clean said spinneret, use is made of seven straight cleaning blades 3 shown in FIG. 7 mounted on a common circular base plate 10. The spacing of the seven cleaning blades 3 corresponds to the spacing of the seven orifice rows of spinneret 1 shown in FIG. 6. To clean the spinneret shown in FIG. 6, cleaning blades 3 mounted on a common base plate 10 (shown in FIG. 7) may perform a circular motion as explained in greater detail in the description of the versions shown in FIGS. 1 to 5, but may also perform a purely reciprocating motion, whereby center point 11 of base plate 10 moves e.g. on a rectilinear moving path 12 as shown in FIG. 6, whereby all points of common base plate 10 and of cleaning blades 3 perform likewise a purely translatory motion of the same path length as that of center point 11.

Figure 8:
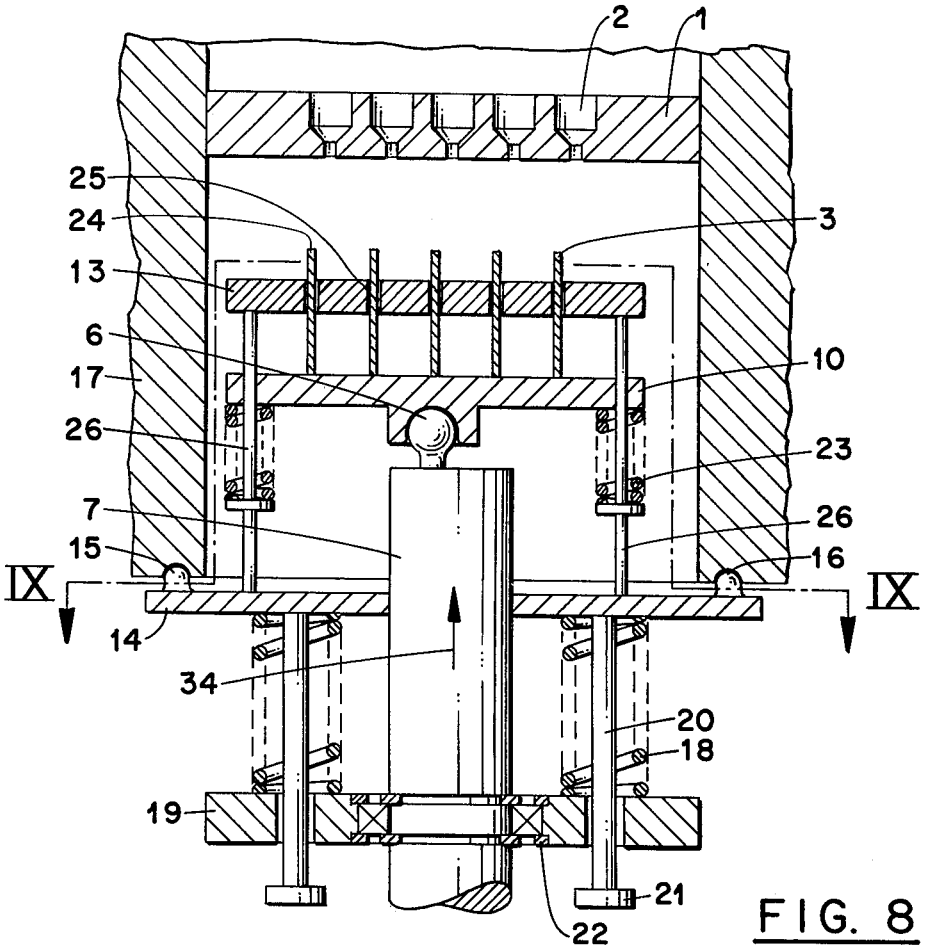
FIG. 8 is a section through a simplified drawing of a version of the device of the invention with five straight cleaning blades arranged on a common base plate with a grid-like plate intended to protect and clean them, along line VIII—VIII of FIG. 9.
Figure 9:
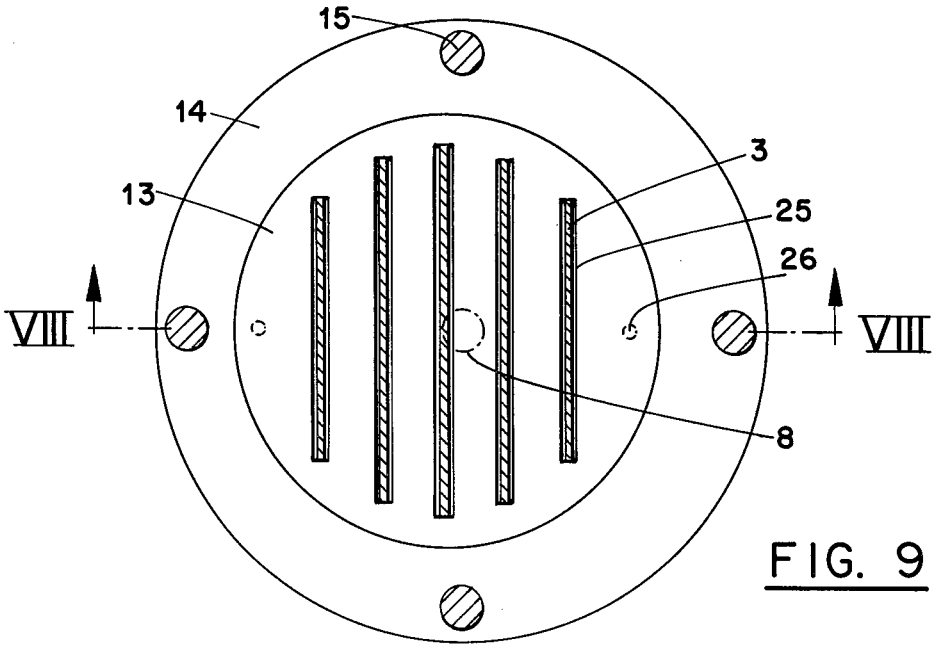
FIG. 9 is a section through FIG. 8 along line IX—IX.

The version shown in FIGS. 8 and 9 of the device of the invention has five straight cleaning blades 3 mounted on a common base plate 10 which may be imparted a circular motion by the eccentric pin 6 of drive shaft 7, as well as a grid-like plate 13, serving to protect and to clean cleaning blades 3. Furthermore, this version has a stop plate 14 with four set pins 15 meshing in corresponding recesses 16 in the spinning machine frame 17. The position of the device of the invention, with respect to spinning orifices 2 of spinneret 1, is thus precisely fixed.

When the device is at rest, the bottom pressure springs 18 are nearly completely relaxed so that entraining ring 19 is in contact with head pieces 21 of the two guide bolts 20. Between ring 19 and drive shaft 7 is provided a radial bearing 22 to avoid translation of the drive shaft 7 rotation to ring 19. Further, when the device is at rest, the top pressure springs 23 are nearly completely compressed so that the upper narrow sides 24 of cleaning blades 3 are located in slots 25 of grid-like plate 13. To clean the five rows of spinning holes 2 in spinneret 1, drive shaft 7 of the device of the invention brought into position by set pins 15 engaging into recesses 16 is moved in the direction of arrow 34, i.e. in the direction of spinneret 1. This causes the bottom pressure springs 18 to be compressed, while simultaneously the top pressure springs 23 are relaxed. This causes cleaning blades 3 to emerge from slots 25 of the grid-like plate 13 until the grid-like plate is in contact with base plate 10. A shaft 7 continues to move in direction of arrow 34, grid-like plate 13 is raised, whereby guide pins 26 firmly connected therewith are also raised, so that while base plate 10, cleaning blades 3, and grid-like plate 13 perform their circular motion while cleaning spinneret 1, said pins do not make contact with stationary stop plate 14. After completion of spinning plate 1 cleaning, the device, as a result of the release of the spring pressure of bottom pressure springs 18, returns automatically to rest position.

Figure 10:
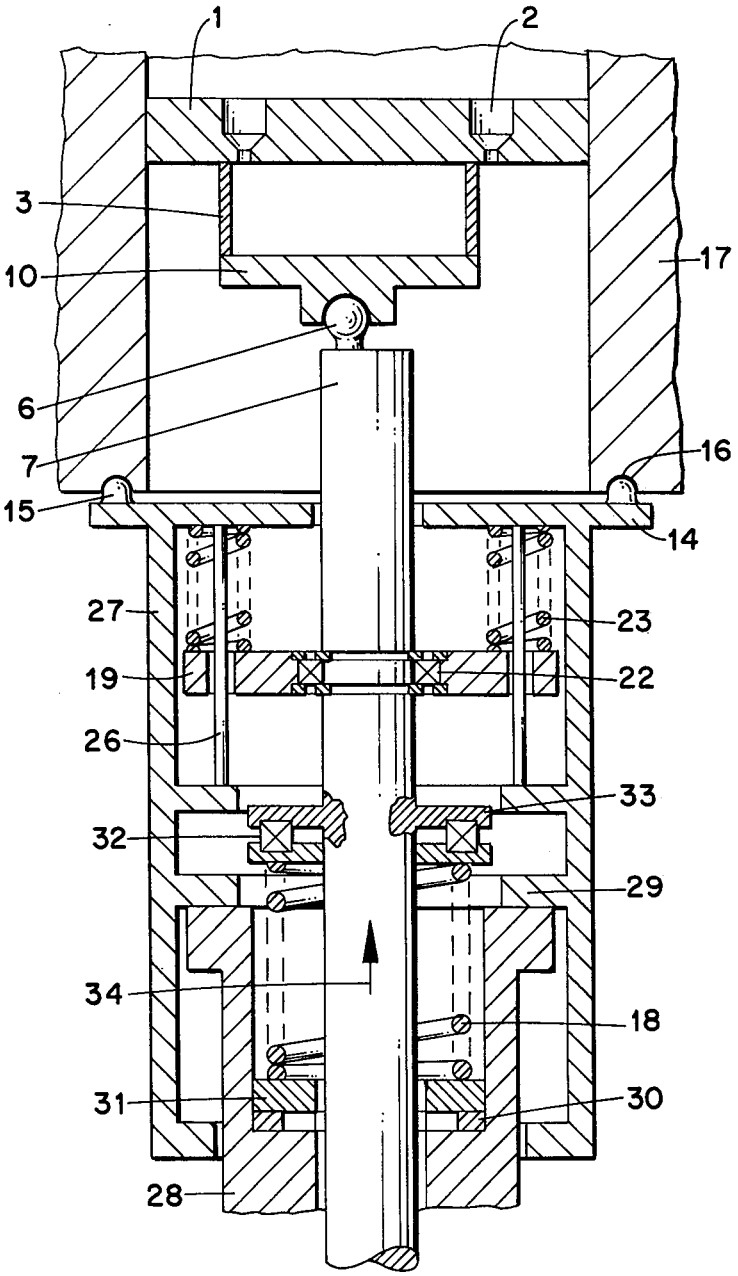
FIG. 10 is a section (shown in simplified form) of a version of the device of the invention whereby the pressure force between cleaning blade(s) and spinneret is adjustable.

FIG. 10 shows a device of the invention with mounted-on base plate 10 a circular cleaning blade 3 to clean spinning holes 2 of an orifice circle on spinneret 1 in operating position. This embodiment is furthermore provided with a housing 27 and stop plate 14 firmly connected with said housing and set pins 15 whose function was explained in detail in the description of the version shown in FIGS. 8 and 9. To clean the spinneret with this embodiment, handle 28 is first moved in the direction of arrow 34, i.e. toward spinneret 1 until said handle makes contact with stop 29 of housing 27. Due to the forward motion of handle 28, drive shaft 7 together with base plate 10 and cleaning blades 3 is also advanced toward the spinneret via spacer ring 30, set ring 31, bottom pressure spring 18, axial bearing 32, and shaft collar 33, until cleaning blade 3 makes contact with the spinneret 1. In this version, the pressure with which cleaning blade 3 is pressed against spinneret 1 is independent of the pressure with which handle 28 is forced upward, since the pressure force is only determined by the force applied by bottom pressure spring 18. The latter in turn can be adjusted to any optional value of proper dimensioning of spacer ring 30 and proper dimensions of bottom pressure spring 18 and top pressure springs 23. The top pressure springs 23 acting via ring 19 and radial bearing 22 on drive shaft 7 insure that, after use and release of handle 28, the device automatically returns to rest postion.

Figure 11:
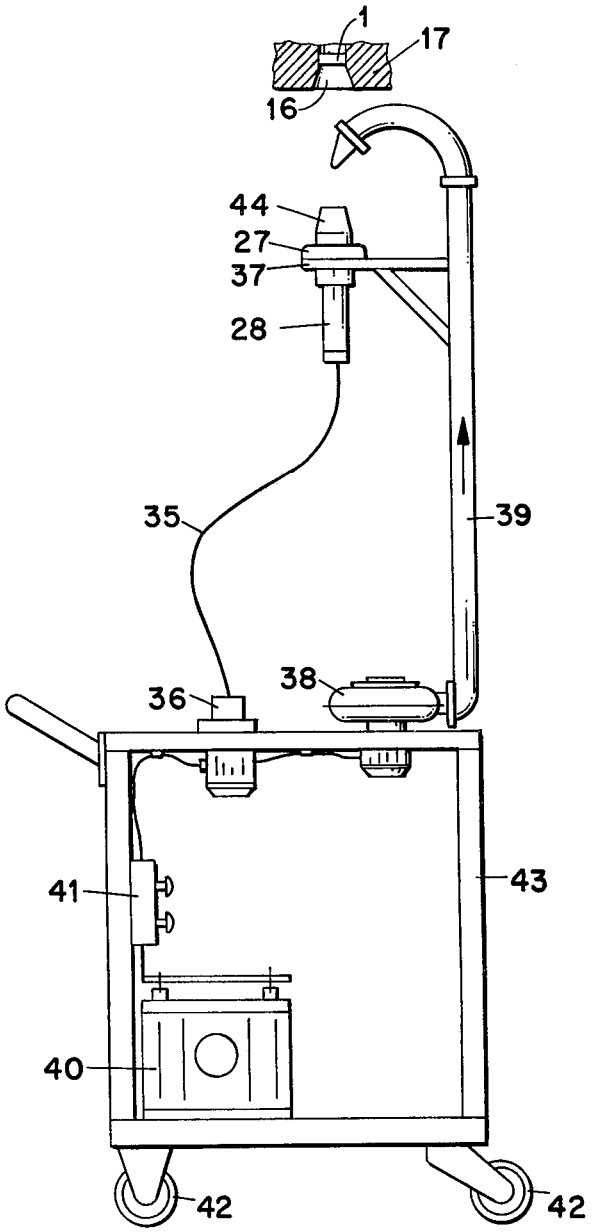
FIG. 11 is a version with displaceable motor and flexible drive shaft for the cleaning blades.

In the version shown in FIG. 11, the cleaning blades mounted in housing 27 are driven via flexible shaft 35 by motor 36. The upper part 44 of housing 27 assumes a conical shape and hence fits the conical recess 16 provided below spinneret 1 in the framing of spinning machine 17. Housing 27 with the cleaning blades and other elements shown in FIGS. 1 to 10 is mounted on support 37. Blowing unit 38 serves to cool the cleaning blades, and supplies cooling air via pipe 39 to the cleaning blades. Drive motor 36 for the cleaning blade and the motor for the cooling unit 38 are connected to electric battery 40 and turned on and off by means of switch 41. All elements of this version are mounted on stand 43 moveable on wheels 42. To clean a spinneret, the operator picks up the element of the device connected via flexible drive shaft 35 with motor 36 by handle 28 from support 37, inserting its upper conical portion 44 in conical recess 16 and pushing by means of handle 28—as described above—the cleaning blades against the spinneret face.

After completion of the cleaning process, the upper portion of the device is returned to support 37, whereupon the cleaning blades are cooled by means of a stream of air provided by blowing unit 38 via pipe 39. To avoid undue loading of electric battery 40, a wiring circuit used with the version shown in FIG. 11 was found eminently suitable whereby the electric motor 36 is turned on e.g. by means of a capacitance switch installed in the mobile element of the device, only just before the cleaning blades come in contact with the spinneret face or only after the optimum pressure force to clean the spinnerets has been reached, and turned off again immediately after release/unloading and whereby cooling blower 38 remains turned on e.g. via a suitable limit switch only as long as the movable element of the device is in support 37, or as is absolutely necessary to cool the cleaning blades. Using a capacitance switch in connection with e.g. a time relay, makes possible a preset cleaning time of the same duration for each spinneret.

EXAMPLE I

To clean spinnerets for the spinning of polyester and bicomponent filaments, which spinnerets had an OD of 85 mm, a device of the invention provided with a grid-like cleaning and protection plate according to FIGS. 8 and 9, with an adjustable pressure force, according to FIG. 10, was successfully used. The spinnerets had each 72 orifices of a diameter of 350 and 500 microns, respectively, aligned in a honeycomb arrangement in 15 rows. In keeping therewith, the device had 15 cleaning blades 1 mm wide. The drive motor was connected by a rigid shaft to the common base plate for the cleaning blades.

The device weighed approximately 7.3 kg. Throughput per spinneret was approximately 3.0 and 3.55 g/sec., respectively. Cleaning blades of MS63F 38bK, MS 60, GG25, GSBZ and AlF32 were successfully used.

EXAMPLE II

A device according to FIG. 11 with elements according to FIGS. 8 and 10 successfully cleaned spinnerets with ten orifices distributed over an orifice circle, said spinnerets being used to spin 40 f 10 polyamide 6 filaments. The device was provided with a circular cleaning blade. The pressure force between cleaning blade and spinneret was about 20 N. The flexible drive shaft to operate said cleaning blades rotated at approximately 3.7 revolutions/sec.

We claim:

1. A portable device for cleaning operating spinnerets for molten synthetic polymers in a spinning housing comprising: at least one cleaning blade movable in a plane parallel to the face of the spinneret, said blade being fixedly attached to a base plate; a rotatable shaft and rotation means therefore; pin means eccentrically located on one end of the shaft for movably attaching the base plate thereto; a stop plate having means for aligning the device relative to said spinneret housing; means for positioning said shaft relative to said stop plate and constraining shaft movement of the shaft substantially toward the spinneret face, the movement in said pin means being sufficient to allow said cleaning blade to conform to said spinneret face and compensate for the difference in alignment between the spinneret housing and face.

2. The portable device of claim 1, wherein said pin means include ball and socket means.

3. The portable device of claim 1, wherein said pin means include universal joint means.

4. The portable device of claim 1, including a stand for holding the device between cleanings and means on said stand for cooling the device.

5. A portable device for cleaning the face of a molten synthetic polymer spinneret during operation comprising a stop plate having means thereon for aligning the stop plate with the housing for said spinneret; a rotatable shaft and means for rotating the same; a ball pin eccentrically attached to one end of said shaft, a base plate having a socket means for attachment to said ball pin; at least one cleaning blade attached to said base plate, the blade being substantially parallel to said spinneret face when said stop plate is aligned with said spinneret housing; means attached to said shaft for guiding said shaft relative to the stop plate and increasingly resisting force of movement of said shaft toward said spinneret face; and means for cleaning said blade after contact with said spinneret face.

6. The portable device of claim 5, wherein said means for cleaning said blade include a grid plate having a slot for receiving the blades, guide pin means positioning the grid plate relative to the blade and stop plate, and spring means to push the grid plate downward over said blade, whereby said guide pin means interact with said stop plate when said shaft moves toward said face plate to expose the blade cleaning surface from said grid plate.

* * * * *